US007635199B2

(12) United States Patent
Guo et al.

(10) Patent No.: US 7,635,199 B2
(45) Date of Patent: Dec. 22, 2009

(54) ILLUMINATION DEVICE HAVING LIGHT SOURCES AND ANGLED REFLECTION BODY

(75) Inventors: Huang-Chen Guo, Junghe (TW); Chen-Yuan Huang, Junghe (TW); Chen-Ming Wang, Junghe (TW); Tzy-Chang Tan, Junghe (TW); Kun-Han Hsieh, Junghe (TW); Kai-Chi Chang, Junghe (TW)

(73) Assignee: UPEC Electronics Corp. (TW)

( * ) Notice: Subject to any disclaimer, the term of this patent is extended or adjusted under 35 U.S.C. 154(b) by 336 days.

(21) Appl. No.: 11/712,731

(22) Filed: Mar. 1, 2007

(65) Prior Publication Data

US 2007/0147048 A1 Jun. 28, 2007

Related U.S. Application Data

(63) Continuation-in-part of application No. 11/356,727, filed on Feb. 17, 2006.

(30) Foreign Application Priority Data

Dec. 8, 2005 (TW) ..... 94221359 U

(51) Int. Cl.
*F21V 1/00* (2006.01)

(52) U.S. Cl. ..... 362/241; 362/345; 362/373

(58) Field of Classification Search ..... 362/247, 362/235, 294, 301, 307, 311.02, 373, 240, 362/241, 249.02, 218, 545, 542
See application file for complete search history.

(56) References Cited

U.S. PATENT DOCUMENTS 5,008,658 A * 4/1991 Russay et al. ..... 345/87
5,255,171 A 10/1993 Clark
5,642,933 A * 7/1997 Hitora ..... 362/243
5,887,968 A * 3/1999 Logan ..... 362/241
6,441,943 B1 * 8/2002 Roberts et al. ..... 359/267
6,851,832 B2 * 2/2005 Tieszen ..... 362/235
7,063,440 B2 * 6/2006 Mohacsi et al. ..... 362/240
7,097,337 B2 * 8/2006 Kim et al. ..... 362/555
7,142,769 B2 * 11/2006 Hsieh et al. ..... 385/146
7,244,058 B2 * 7/2007 DiPenti et al. ..... 362/547
7,278,761 B2 * 10/2007 Kuan ..... 362/294
2002/0118548 A1 * 8/2002 Kuenstler et al. ..... 362/518

* cited by examiner

*Primary Examiner*—Gunyoung T Lee
(74) *Attorney, Agent, or Firm*—Baker & McKenzie LLP

(57) ABSTRACT

The present invention is related to an illumination device capable of producing ambient light and whose structure can be efficiently manufactured and assembled. The illumination device comprises: a substrate electrically connect to a power supply, a plurality of light sources attached to a surface of the substrate, a reflection body with a reflection surface situated a distance from said plurality of light sources, a shell having a diffusion surface situated a distance from said reflection surface. The illumination device may further comprise a housing for receiving and supporting the substrate and the reflection body. The housing is configured to join with the shell and can be further attached to an external device receiving the ambient light. The light emitted from the light sources is reflected by the reflection body to the diffusion member and then radiates outwardly to the surrounding environment of the shell. The reflection surface of the reflection body is inclined at angle relative to the substrate. Said reflection angle formed by the reflection surface and the substrate can be adjusted so that the light is effectively reflected by the reflection surface to the surrounding environment of the device.

36 Claims, 6 Drawing Sheets

ILLUMINATION DEVICE HAVING LIGHT SOURCES AND ANGLED REFLECTION BODY

RELATED APPLICATION

This application is a continuation in part of U.S. patent application entitled "Illuminating Device" Ser. No. 11/356,727 filed Feb. 17, 2006, which claims the benefit of the foreign application Taiwan 094221359 filed Dec. 8, 2005.

FIELD OF THE INVENTION

The present invention relates to an illumination device, and more particularly, to an illumination device capable of providing light emitted from a series of internal light sources and deflects out to an ambient environment. Such illumination device may be used as a backlight for computer monitors, televisions and audio apparatuses.

BACKGROUND OF THE INVENTION

While it is known that televisions and computer monitors utilize flat panels and digital techniques to improve dimensional size and display quality, more improvements, such as 3D digital comb filters and 3D digital noise reduction, are currently under development. Recently, research and development efforts were made to improve the external environment of the display apparatus by using illumination devices as a means to provide ambient light to the external environment, i.e. the environment surrounding the display apparatus, such as the nearby walls.

Ambient light provided by the illumination device to the external environment of a display apparatus can create a comfortable atmosphere for the viewers. The viewers not only can enjoy the images on the display apparatus but also the ambient environment generated by the ambient light from the illumination device.

The ambient light can work with the images shown on the display apparatus. For instance, when a video on a television shows a thunderstorm, a dark and lightning effect can be created by the illumination device. More specifically, when lightning is shown on the screen, a flash can be generated by the ambient light to produce the effect of lightning in conjunction with the schemes on the screen. Therefore, the ambient light may be dynamic depending upon the contents shown on the display apparatus.

Moreover, sound can also play a significant role in creating different viewing experiences. Ambient light generated by the illumination device can work with sounds to create different viewing experiences for the audience.

Another example that demonstrates the need for ambient light is when the screen is small and does not cover the entire wall in front of the viewers. Here, the viewers must concentrate and focus on the small display screen and their eyes need to adjust frequently between the brightness of the image on the display screen and the surrounding environment. The ambient lighting technique can reduce the difference in brightness between the display screen and the surrounding environment such that the stress on viewers' eyes is reduced.

U.S. Pat. No. 5,255,171, entitled "Colored Light Source Providing Intensification of Initial Source Illumination", by L. Douglas Clark discloses an illuminating device utilizing light emitting diodes ("LED") as light sources and a reflector with parabolic reflecting walls. This illuminating device comprises various LEDs positioned at the base of the reflector and a diffuser attached to the opposite end thereof. However, this prior art primarily focuses on a light concentrator for use with a color optical scanning device, such as a line scanning imaging system or an area scan imaging system.

A suitable light source for projecting ambient light is selected based on factors such as: the light transmittance, mixture of different color LEDs, response time of the LEDs, orientation of light projection and the reflectivity of light. Furthermore, one can also physically combine such ambient light sources with a display apparatus or an audio apparatus since audio-video ("AV") apparatuses are widely available.

Most ambient light illumination devices that use LEDs as light source adopt a complex design. For instance, such device may comprise a housing, a substrate or printed circuit board (PCB), a soft layer, a reflection plate, an adhesive layer, a diffusion layer and an external shell. This multi-layer structure makes it difficult to design, manufacture, assembly or maintain the illumination device. For the utilization of the LEDs on the PCB, all the necessary components positioned above the LEDs need to be carefully designed and arranged. Such complex structure can be very costly. In addition, having many separated parts and layers are not desirable since each layer will need to satisfy the conditions of the LEDs used. This may affect the overall performance of the illumination device.

The components of the abovementioned illumination devices, in particular the reflection plate, are typically made of metal. However, metal components are subject to oxidation when placed in contact with humidity. Since the inside of the illumination device is not in vacuum, the use of metal is not desirable in the long run. This is particularly true for multi-layered structure since the spaces among the layers can increase contact surface to air and water, thus promoting the oxidation process. Moreover, structure with multiple layers is not preferred when the temperature can rise inside the illumination device. As the LEDs emit light, the internal temperature increases. The design of the illumination device must take into account the rising temperature so that each layer and the structure as a whole can withstand the heat.

In view of the above, it is desirable to provide an illumination device that can effectively provide ambient light and can be economically manufactured and maintained. The present invention provides an illumination device with a simplified structure that can facilitate the manufacturing process and can generate and reflect light effectively. The present invention also provides the technical solutions to the deficiencies of the prior illumination device.

SUMMARY OF THE INVENTION

One aspect of the invention is to provide an illumination device that can generate ambient light to the surrounding environment.

Another aspect of the invention is to provide an illumination device with a structure that can adapt to the changes in operating environment, in particular the temperature and the humidity changes.

Another aspect of the invention is to provide an illumination device with a structure that can effectively produce and reflect light and that can be easily assembled so that the overall manufacturing process is simplified and the cost reduced.

According to one embodiment of the present invention, an illumination device comprises: a substrate, a plurality of light sources attached to a surface of the substrate, a reflection body with a reflection surface situated a distance from said plurality of light sources, a shell having a diffusion member situated a distance from said reflection surface; wherein the light emitted by the light sources on the substrate travels to the reflection surface of the reflection body upon which the light is reflected to the diffusion member of the shell and then radiate outward through a diffusion surface. A reflection angle is formed by the reflection surface and the substrate. Said reflection angle can be adjusted so that the light is effectively reflected by the reflection surface. This embodiment can be further attached to a housing adapted to hold the abovementioned structure. One of the purposes of the housing is to provide a means for securing the abovementioned components. The housing can also be used as a means for connecting the abovementioned structure to an external device, such as a television or a LCD display screen.

According to another embodiment, an illumination device comprises: a substrate, a plurality of light sources attached to a surface of the substrate, and a light reflection shell having a reflection member and a diffusion member situated a distance from said plurality of light sources; wherein said reflection member includes a reflection surface situated a distance from the light sources and said diffusion member includes a diffusion surface situated a distance from the reflection surface so that the light emitted by the light sources are reflected by the reflection surface to the diffusion member and then radiates outwardly from the diffusion surface to the external environment of the shell. The reflection member and the diffusion member are formed integrally with the shell. A reflection angle is formed by the reflection surface and the substrate. Said reflection angle can be adjusted so that the light is effectively reflected by the reflection surface. This embodiment can be further attached to a housing adapted to hold the abovementioned structure. One of the purposes of the housing is to provide a means for securing the abovementioned components. The housing can also be used as a means for connecting the abovementioned structure to an external device, such as a television or a LCD display screen.

According to another preferred embodiment of the present invention, an illumination device comprises: a housing, a substrate secured to the housing, a plurality of light sources attached to a surface of the substrate, a reflection body having a reflection surface situated a distance from the light sources, and a shell having a diffusion member situated a distance from the reflection surface such that the light emitted from the light sources is reflected by the reflection surface to the diffusion member and then radiates outwardly from the diffusion surface to the external environment. A reflection angle is formed by the reflection surface and the substrate. Said reflection angle can be adjusted so that the light is effectively reflected and directed by the reflection surface. One of the purposes of said housing is to provide a means for securing the abovementioned components. The housing can also be used to connect the abovementioned structure to an external device, such as a television or a LCD display screen.

BRIEF DESCRIPTION OF THE DRAWINGS

The present invention may be embodied in various forms with reference to the following drawings. The drawings depict only the preferred embodiments of the invention and shall not to be considered as limiting the scope of the present invention.

DESCRIPTION OF EMBODIMENTS OF THE INVENTION

Figure 1:
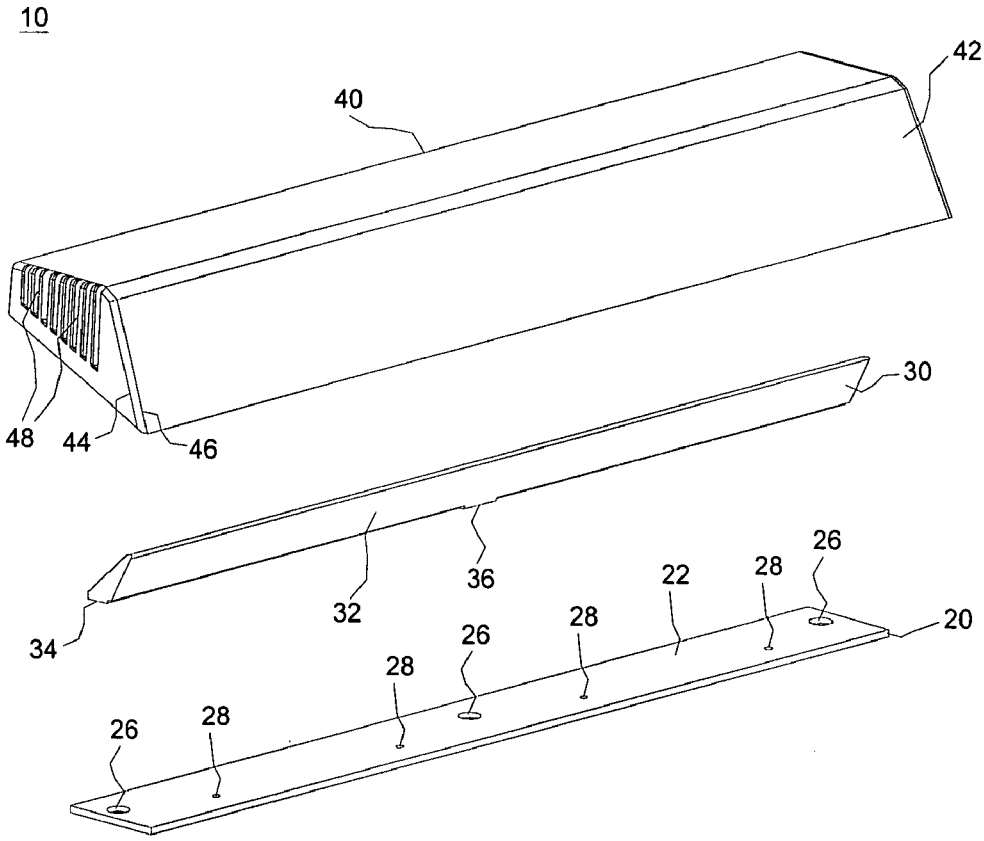
FIG. 1 is an exploded perspective view of a preferred embodiment of the illumination device of the present invention.
Figure 2:
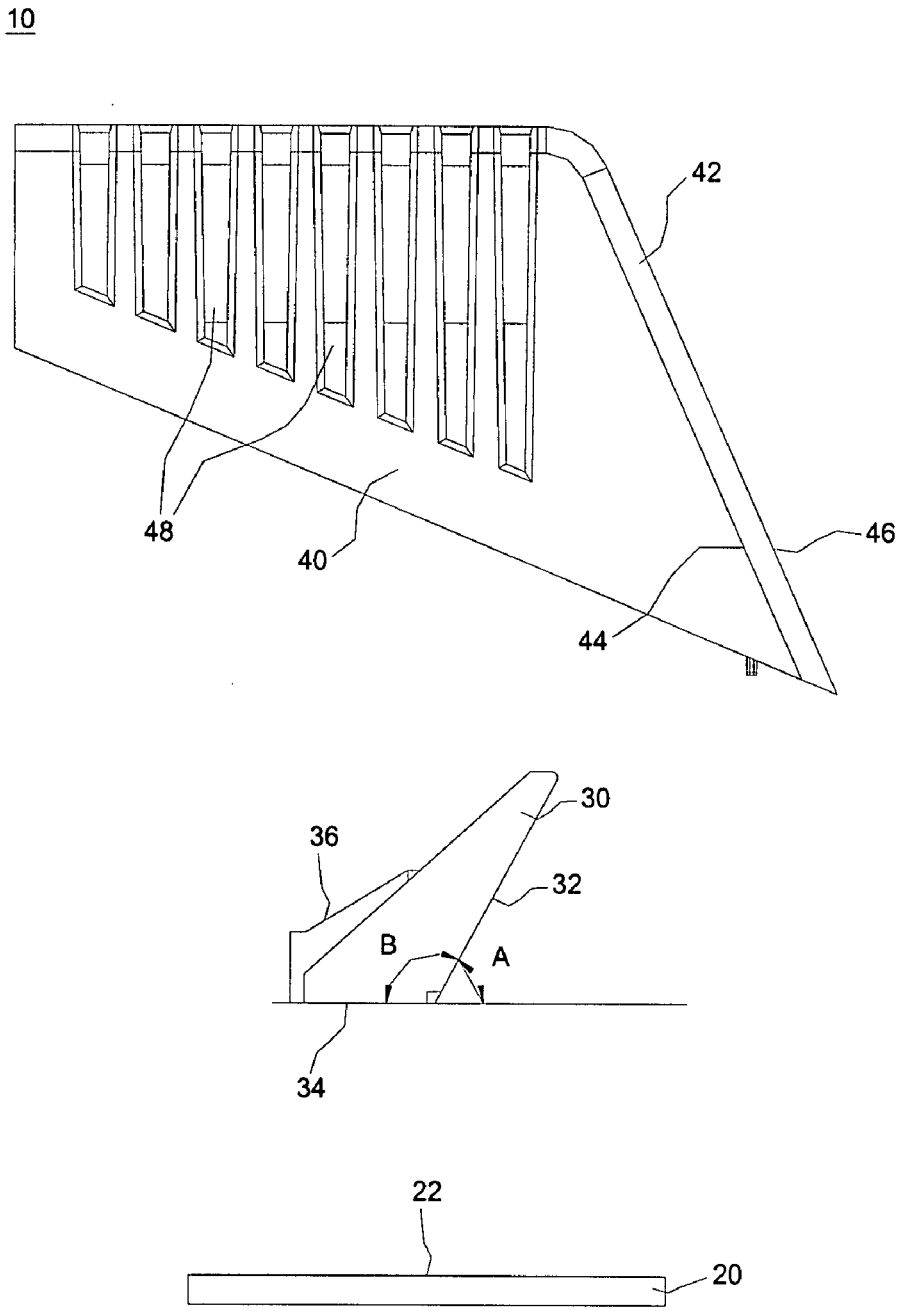
FIG. 2 is an exploded side elevational view of the illumination device shown in FIG. 1.

FIGS. 1 and 2 show an exploded perspective view and an exploded side view of an embodiment of the illumination device. As shown in FIGS. 1 and 2, one embodiment of an illumination device 10 comprises: a substrate 20, a plurality of light sources 28 attached to a surface 22 of the substrate 20, a reflection body 30 with a reflection surface 32 situated a distance from said plurality of light sources 28, a shell 40 having a diffusion member 42 situated a distance from said reflection surface 32; wherein the diffusion member further comprises a diffusion surface located a distance from the reflection surface 32; and the light emitted from the light sources 28 is reflected by the reflection surface 32 to the diffusion member 42 and then radiates outwardly from the diffusion surface 46 to the external environment of the shell 40. The abovementioned technical features and mechanical structure are described in detailed as follows.

First, the ambient light of the illumination device 10 is provided by the light sources 28 attached to a surface 22 of a substrate 20. In one embodiment, the light sources 28 are soldered to said surface 22. The illumination device 10 may further comprise an external power supply (not shown) electrically connected to the substrate 20 to provide the electricity needed by said light sources 28 to generate ambient light. The illumination device 10 may also include data lines (not shown) that can be used to communicate with external apparatus, such as audio or display devices. The light sources can be a light emitted diode (LED) or any other suitable lighting device. The light sources 20 may generate different colors of light, e.g., red, green and blue. One preferred embodiment is to arrange the light sources 28 in equal distance to each other and most preferably, align the light sources longitudinally along the length of the substrate 20 such that uniform lighting can be achieved. Furthermore, the light sources 28 are preferably attached parallel to the flat surface 22 such that the light emitted by the light sources 28 travels upwardly and substantially perpendicular to the substrate 20. The surface 22 of the substrate 20 can be further coated with a nonconductive protection layer resistant to structural deformation caused by external forces or pressure, such as the bombarding of debris or particles. It can also be coated with water-resistance material. A preferred embodiment of the protection layer is a urethane resin or an epoxy resin such that the substrate is resistant to dust, water, heat or deformation.

Light emitted by the light sources 28 on the substrate 20 travels upwardly to the reflection surface 32 of the reflection body 30. In one embodiment, the reflection body 30 is at least partially secured to the substrate 20 by means of an attachment to the surface 22 using screws or adhesive joiners. The reflection body 30 comprises a reflection surface 32 and a bottom surface 34. The reflection surface 32 is generally flat and non-transparent and the light traveled thereto is reflected at an angle formed by the reflection body 30 and the substrate 20. As shown in FIG. 2, the bottom surface 34 of the reflection body 30 is generally flat and is attached to the surface 22 of the substrate 20. The reflection surface 32 is inclined at an angle A to reflect the light that travels towards it. An angle B is formed between the reflection surface 32 and the bottom surface 34. In a preferred embodiment, angles A and B are supplementary to each other, i.e. ∠A+∠B=180°. Angle A, however, can be set to any degree. In one embodiment, the angle A is between 5° and 90° (or more specifically, 5°≦A<90°). Most preferably, the angle A is 61°.

The reflection body 20 can be made of thermoplastic or thermosetting materials of great rigidity and heat resistance, such as ABS, PP, PMMA or the like. The reflection body 20 can also be made of composite materials or metallic materials. In one embodiment, the reflection body 20 is made of thermosetting plastic using injection molding processes. The reflection surface 22 is generally a flat surface with high light reflection coefficient. The coefficient is related to the reflectivity of light from a surface depending on the angle of incidence and the plane of polarization. The reflection body 30 can be attached to the substrate 20 by means of, for example: screw fixation, hook engagement, thermal bonding, press-fit, insertion, adhesive bonding, inserted pin fixation, slidable pin fixation, rotatable pin fixation, soldering, and/or friction press-fitting. In one embodiment, the reflection body 30 is secured to the substrate 20 utilizing nuts and bolts. A bolt through the opening 36 and the hole 26 is joined with a nut such that the reflection body 30 and the substrate 20 are securely attached. In another embodiment, the reflection body 30 is secured to the substrate 20 by screws. A screw that passes through the opening 36 and the hole 26 can be applied to an protrusion or a securement member containing internal threads of a housing. Details relating to the housing are described in the later sections.

Once the light reaches the reflection surface 32 and is reflected therefrom, the light travels to a shell 40, in particular to a diffusion member 42 of the shell 40. As shown in FIGS. 1 and 2, the diffusion member includes a receiving plane 44 and a diffusion surface 46. When the light hits the receiving plane 44, it is diffused and then radiates outwardly from the diffusion surface 46. In one embodiment, the diffusion member 20 is made of thermosetting plastic and is preferably transparent or semi-transparent with low light reflection coefficient. The diffusion member 42 is preferably formed integrally with the shell 40 by injection molding as an one-piece component. The shell 40 covers at least a portion of the reflection body 30 and the substrate 20 and most preferably, covers the reflection body 30 and the substrate 20 entirely, so that the covered components are adequately protected from dust and/or other external contaminants.

The shell 40 may further contain a plurality of slots 48. Preferably, said slots 48 are arranged on the sides of the shell 40. The slots 48 mainly provide air circulation such that the internal temperature of the shell 40 can be reduced and that the substrate 20 and the reflection body 30 are protected from over heat.

Figure 3:
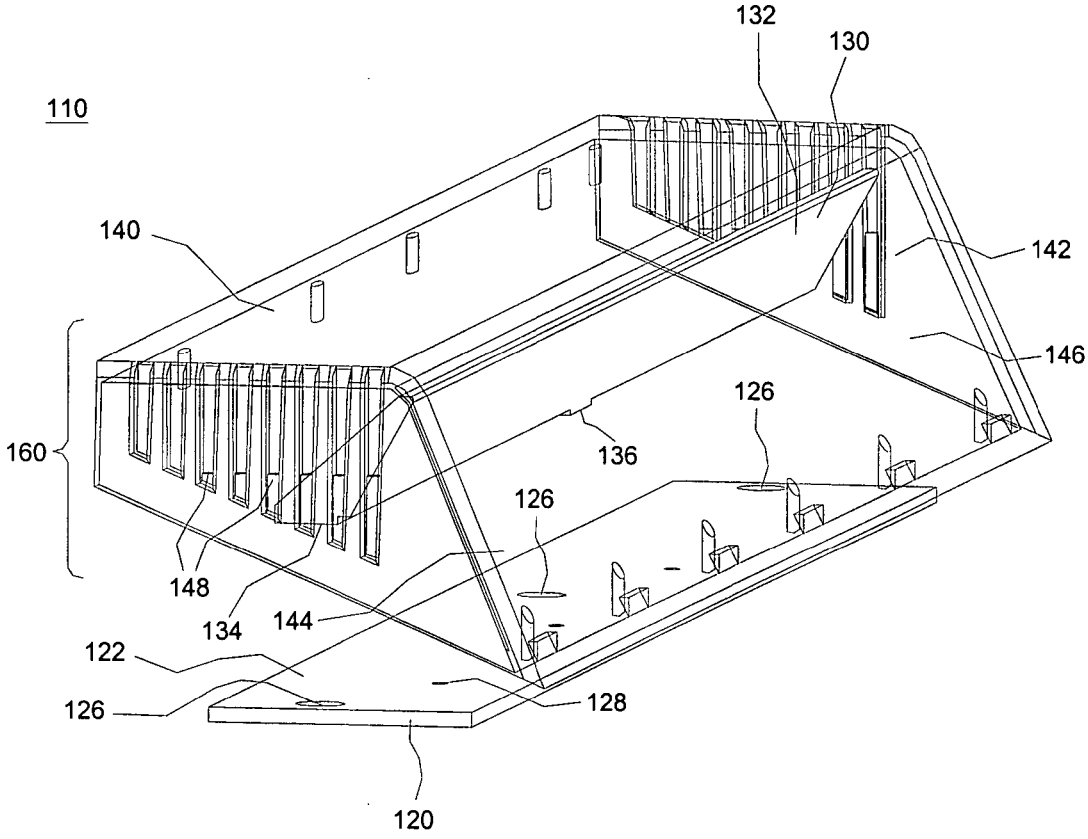
FIG. 3 is a perspective view of another preferred embodiment of the illumination device.
Figure 4:
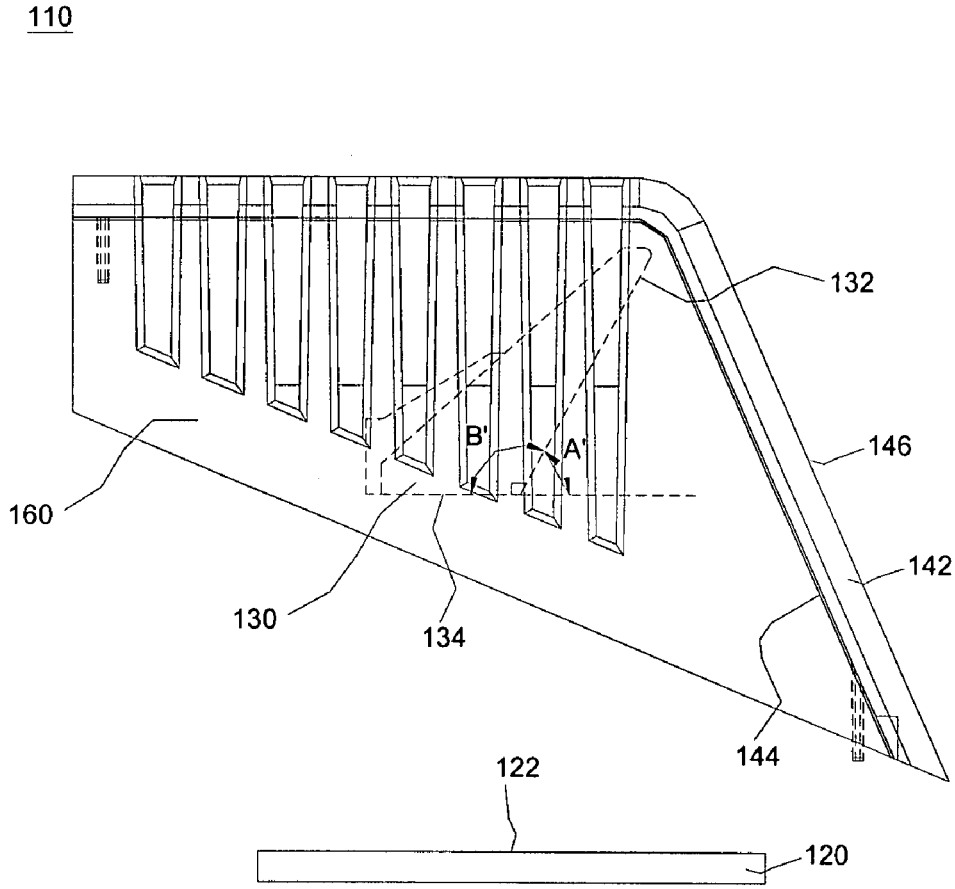
FIG. 4 is a side elevational view of the illumination device shown in FIG. 3.

FIGS. 3 and 4 show a second preferred embodiment of the illumination device 110. In this embodiment, the components above the substrate 120 such as the shell 140, reflection member 130 and the diffusion member 142 are formed integrally as an one-piece object—light reflection shell 160. Preferably, the light reflection shell 160 is made of thermoplastic or thermosetting materials, composite materials or metallic materials. In one embodiment, the light reflection shell 160 is made of a thermosetting plastic with high temperature resistance and rigidity and is formed using injection molding processes. The reflection surface 132 has a high light reflection coefficient; whereas the diffusion member 142 has a low light reflection coefficient. In this preferred embodiment, the reflection member 130 is provided with a reflection surface 132 inclined at an angle A' so that the light emitted from the light sources 122 on the substrate 120 can be reflected. Referring to FIG. 4, the reflection surface 132 and the bottom surface 134 form an angle B'. Preferably, ∠A'+∠B'=180°. The angle A' can be set to any degree. In one embodiment, the angle A' is between 5° and 90° (or more specifically, 5°≦A'<90°). Most preferably, the angle A' is 61°. The light that hits the reflection member 130 is reflected by the reflection surface 132 and further travels to the diffusion member 142. As shown in FIGS. 3 and 4, said diffusion member 142 is provided with a receiving plane 144 and a diffusion surface 146, wherein the light hits the receiving plane 144 and radiates outwardly from the diffusion surface 146. The light reflection shell 160 can be joined with the substrate 120 by attaching the bottom surface 134 to the surface 122 with, for example: screw fixation, hook engagement, thermal bonding, press-fit, insertion, adhesive bonding, inserted pin fixation, slidable pin fixation, rotatable pin fixation, soldering, and/or friction press-fitting. In one embodiment, the light reflection shell 160 is secured to the substrate 120 utilizing nuts and bolts. A bolt through the opening 136 of the light reflection shell 160 and the hole 126 of the substrate 120 is joined with a nut such that the light reflection shell 160 and the substrate 120 are securely attached. In another embodiment, the light reflection shell 160 is secured to the substrate 120 by screws. A screw that passes through the opening 136 and the hole 126 can be applied to an protrusion or a securement member containing internal threads of a housing.

The light reflection shell 160 also includes the diffusion member 142. The light received at the receiving plane 144 is diffused by the diffusion surface and then radiates outwardly therefrom. Preferably, the shell 160 is either transparent or semi-transparent with the diffusion member 142 coated with a medium of low light reflection coefficient to achieve the desired light diffusion. The shell 160 may further contain a plurality of slots 148. The slots 148 are preferably arranged on the sides of the shell 160. The slots 148 provide air circulation such that the internal temperature of the shell 160 is reduced and that the substrate 120 and the reflection member 130 are protected from over heat.

The abovementioned embodiments can provide desired ambient light to illuminate surrounding areas. Another preferred embodiment of the present invention is described in detail in the subsequent content with reference to FIGS. 5 and 6. This embodiment further comprises a housing 250. The main function of the housing 250 is to provide securement for the various components recited in previous embodiments. A preferred design of the housing 250 is described below but other variations are also available and within the scope of the present invention.

Figure 5:
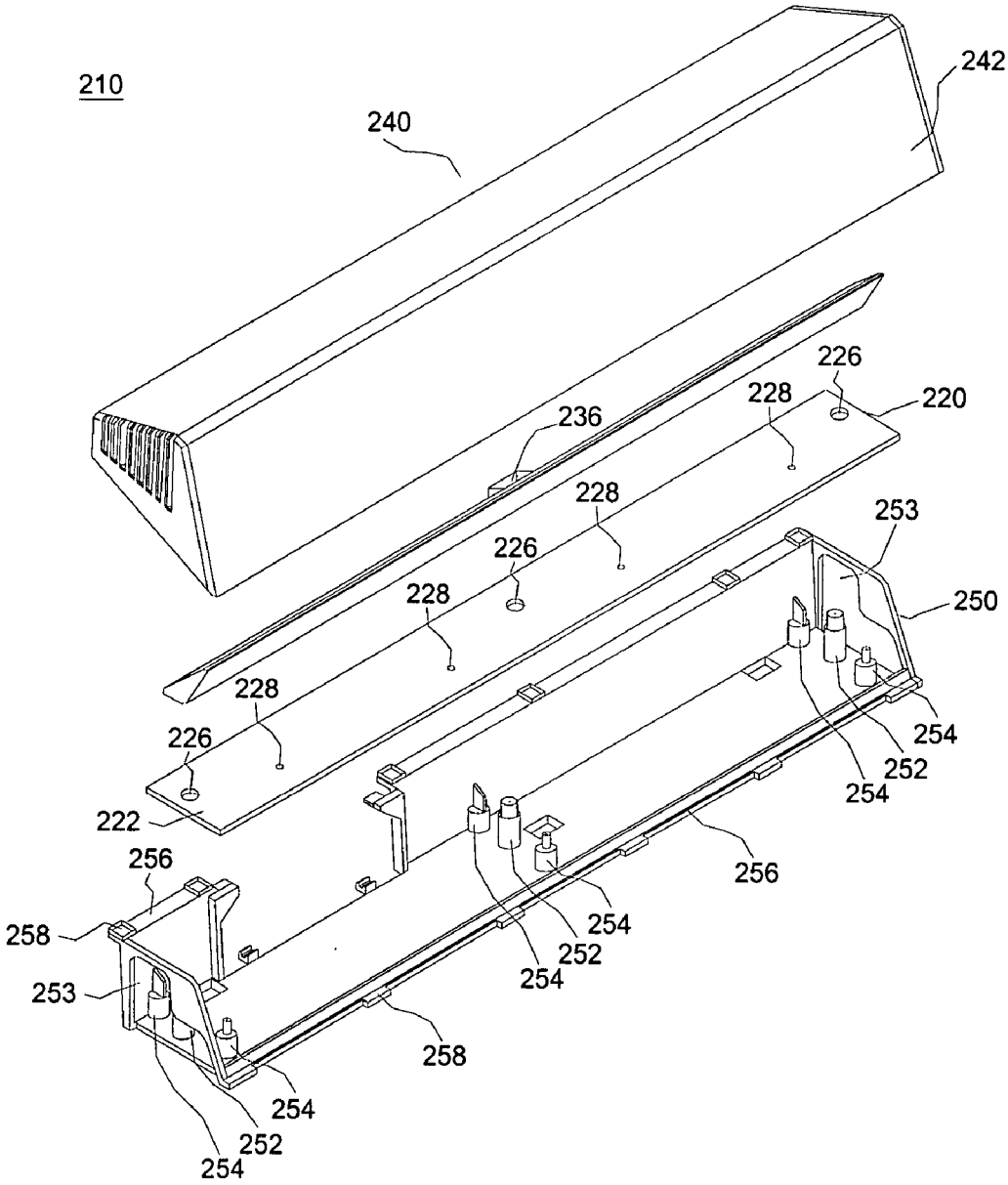
FIG. 5 is an exploded perspective view of another preferred embodiment of the illumination device.
Figure 6:
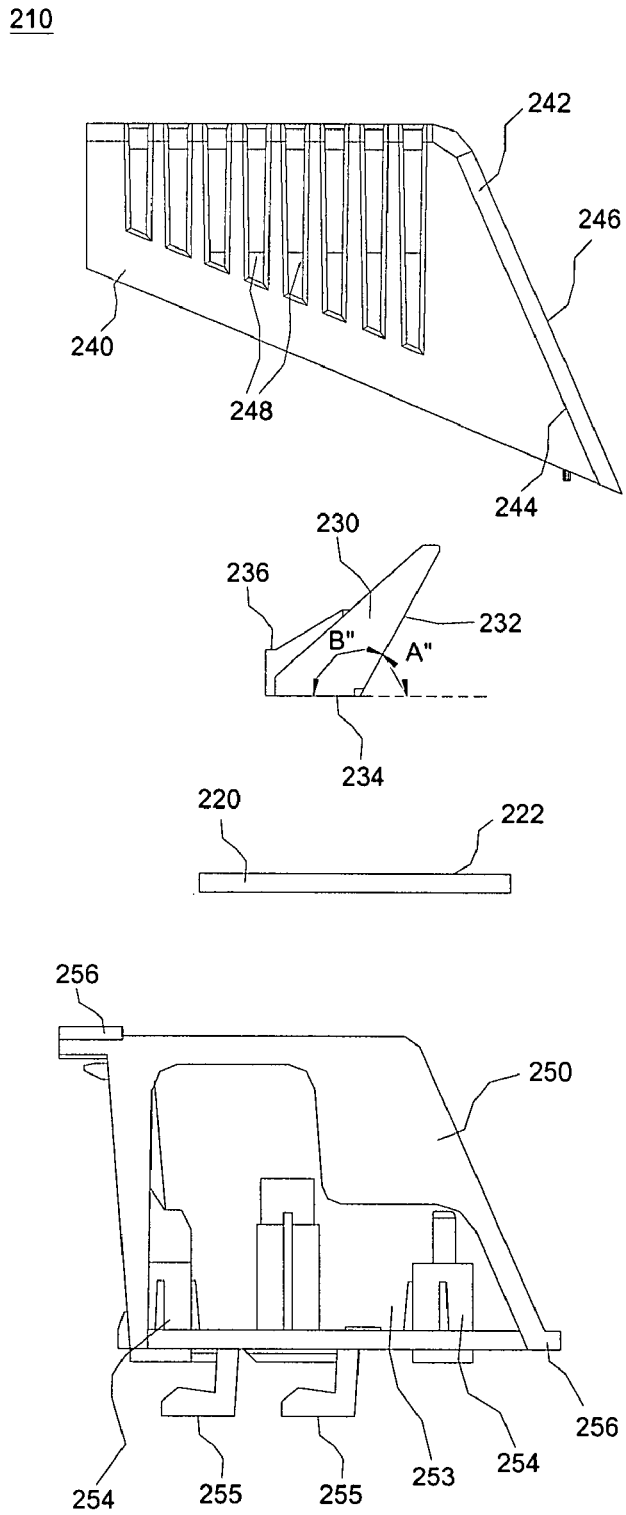
FIG. 6 is an exploded side elevational view of the illumination device shown in FIG. 5.

Referring to FIGS. 5 and 6, a preferred embodiment of the illumination device 210 is illustrated. This embodiment mainly differs from the previous embodiments in that a housing 250 is attached. The housing 250 is used to hold various components in the illumination device and may also be utilized as a base for connecting or attaching to an external device (not shown), such as a display screen. The illumination device 210 comprises a substrate 220, a plurality of light sources 228 on a surface 222, a reflection body 230 that is situated at a distance from said substrate 220 and that has a reflection surface 232 situated a distance from the light sources 228, and a shell 240 with a diffusion surface situated a distance from the reflection surface 232; wherein the light emitted from the light sources 228 reaches the reflection surface 232 and reflected thereupon to a diffusion member 242 and then radiates outwardly to the external environment of the shell 240.

The reflection surface 232 of the reflection body 230 forms an angle A" with the horizontal plane to reflect and direct light. The reflection surface 232 and the bottom surface 234 also form an angle B". Preferably, ∠A"+∠B"=180°. The angle A" can be set to any degree. In one embodiment, the angle A" is between 5° and 90° (or more specifically, 5°≦A"<90°). Most preferably, the angle A" is 61°. The light that hits the reflection body 230 is reflected by the reflection surface 232 and further travels to the diffusion member 242. As shown in FIGS. 5 and 6, said diffusion member 242 is provided with a receiving plane 244 and a diffusion surface 246. Light that hits the receiving plane 244 will radiate outwardly from the diffusion surface 246.

The housing 250 is preferably arranged beneath the substrate 220, reflection body 230 and the shell 240. As shown in FIG. 5, the housing 250 comprises a plurality of securement members 252 and supports 254. A plurality of through holes 226 are provided on the substrate 220 to correspond to the locations of the securement members 252 on the housing 250 to allow these securement members 252 to pass through. The locations of the through holes 226 are preferably arranged some distant away from the light sources 228. One specific embodiment of the securement members 252 is a plastic protrusion with internal threads to receive screws and is formed integrally with the housing 250. The substrate 220 is secured to the housing 250 via the securement members 252 and is maintained at a distance from the base of the housing 250 by the supports 254. Furthermore, the reflection body 230 is attached to the surface 222 of the substrate 220 and contains at least an opening 236 that corresponds to the position of at least one of the through-holes 226. Preferably, the through-holes 226 on the substrate 220 are aligned with the securement members 252 of housing 250 such that the reflection body 230 and the substrate 220 are attached in conjunction with the housing 250 via attachment means such as screws. The attachment means passes through both the opening 236 and the through-holes 226 and secures itself with at least one of the securement members 252. Via such an efficient attachment, the manufacturing processes can be simplified and made more cost effective. As mentioned previously, the attachment of the components can also be implemented in other ways such as: screw fixation, hook engagement, thermal bonding, press-fit, insertion, adhesive bonding, inserted pin fixation, slidable pin fixation, rotatable pin fixation, soldering and/or friction press-fitting.

As shown in FIGS. 5 and 6, the edges of the housing 250, in particular the front and rear protruding edges 256, further comprises a plurality of pores 258 to engage the shell 240. The shell 240 preferably covers the housing 250, the substrate 220 and the reflection body 230. A plurality of protrusions (not shown) corresponding to the pores 258 can also be provided at the front and rear edges of the shell 240 for both the positioning and engagement of the shell 240 onto the housing 250. Said engagement can be implemented by means of: screw fixation, hook engagement, thermal bonding, press-fit, insertion, adhesive bonding, inserted pin fixation, slidable pin fixation, rotatable pin fixation, soldering and/or friction press-fitting.

The shell 240 may further comprise a plurality of slots 248. Preferably, the slots 248 are located on the sides of the shell 240. The slots 248 can facilitate air circulation such that the heat generated by the light sources 228 inside the shell 240 can be dissipated The housing may further provide a plurality of openings 253 to facilitate air circulation inside the housing 250 so that the heat generated by the light sources can be dissipated properly. The housing 250 may further include an attachment member 255, formed integrally therein and preferably on an external surface of the housing 250, such that the attachment member 255 provides a means of attaching the housing 250 to an external device (not shown), such as a display screen.

While the present invention is disclosed by reference to the embodiments detailed herein, note that these examples are intended in an illustrative rather than in a limiting sense. It is contemplated that other modifications and combinations will readily occur to those skilled in the art and will be within the spirit of the invention and the scope of the following claims.

What is claimed is:

1. An illumination device, comprising:

a substrate having a top surface;

a plurality of light sources attached on the top surface of the substrate;

a light reflection shell having a reflection body and a diffusion member arranged a distance from the light sources;

wherein the reflection body comprises a reflection surface situated a distance from the light sources, and the diffusion member comprises a diffusion surface situated a distance from the reflection surface;

the reflection body being fixedly attached on the top surface of the substrate at a position spaced apart from the light sources, and the reflection surface extending at an inclined angle from the top surface of the substrate toward an upside of the light sources; whereby the light emitted from the light sources is reflected by the reflection surface toward the diffusion surface and then radiates outwardly through the diffusion surface to a surrounding environment of the shell; and a housing having a plurality of air circulation openings on side walls;

wherein the shell covers the housing, and slots located on sides of the shell are aligned with the plurality of openings on the housing.

2. The illumination device of claim 1, wherein the reflection body further comprises a bottom surface that lies parallel to the top surface of the substrate when attached on the top surface of the substrate.

3. The illumination device of claim 1, wherein the inclined angle is between 5 degree and 90 degrees.

4. The illumination device of claim 1, wherein the light reflection shell covers a portion of the substrate and the reflection body.

5. The illumination device of claim 1, wherein the light sources are arranged at equal distance from each other and are aligned longitudinally along a length of the substrate.

6. The illumination device of claim 1, wherein the reflection body and the diffusion member are both formed integrally with the light reflection shell.

7. The illumination device of any one of claim 1 or 2, wherein the reflection body is attached on the top surface of the substrate via screw fixation.

8. The illumination device of claim 2, wherein an adhesive layer is provided between the bottom surface of the reflection body and the top surface of the substrate such that the reflection body is adhesively joined with the top surface of the substrate.

9. The illumination device of any one of claim 1 or 4, wherein the light reflection shell is configured to completely cover the substrate and the reflection body.

10. An illumination device, comprising:

a substrate having a top surface;

a plurality of light sources attached on the top surface of the substrate;

a reflection body with a reflection surface situated a distance from the light sources, wherein the reflection body is fixedly attached on the top surface of the substrate at a position spaced apart from the light sources, and the reflection surface extends at an inclined angle from the top surface of the substrate toward an upside of the light sources; and a shell having a diffusion surface situated a distance from the reflection surface, wherein the shell is mounted over the top surface of the substrate to substantially enclose the reflection body;

wherein the diffusion surface is situated a distance away from the reflection surface; the light emitted from the light sources is reflected by the reflection surface to the diffusion surface and then radiates outwardly through the diffusion surface to a surrounding environment of the shell; and a housing having a plurality of air circulation openings on side walls;

wherein the shell covers the housing, and slots located on sides of the shell are aligned with the plurality of openings on the housing.

11. The illumination device of claim 10, wherein the reflection body further comprises a bottom surface that lies parallel to the top surface of the substrate when attached with the substrate.

12. The illumination device of claim 10, wherein the inclined angle is between 5 degree and 90 degrees.

13. The illumination device of claim 10, wherein the shell covers a portion of the substrate and the reflection body.

14. The illumination device of claim 10, wherein the light sources are arranged in equal distance from each other and are aligned longitudinally along a length of the substrate.

15. The illumination device of claim 10, wherein the diffusion member is formed integrally with the shell.

16. The illumination device of any one of claim 10 or 11, wherein the reflection body is attached with the substrate via screw fixation.

17. The illumination device of claim 11, wherein an adhesive layer is provided between the bottom surface of the reflection body and the top surface of the substrate such that the reflection body is adhesively joined with the top surface of the substrate.

18. The illumination device of any one of claim 10 or 13, wherein the shell is configured to completely cover the substrate and the reflection body.

19. An illumination device, comprising:

a housing;

a substrate secured with the housing;

a plurality of light sources attached on a top surface of the substrate;

a reflection body with a reflection surface situated a distance from the light sources, wherein the reflection body is fixedly attached on the top surface of the substrate at a position spaced apart from the light sources, and the reflection surface extends at an inclined angle from the top surface of the substrate toward an upside of the light sources;

a shell having a diffusion member situated a distance from the reflection surface and configured to join with the housing;

wherein the diffusion member comprises a diffusion surface situated a distance from the reflection surface; the light emitted from the light sources is reflected by the reflection body toward the diffusion member and then radiates outwardly through the diffusion surface to a surrounding environment of the shell and the housing; and the housing having a plurality of air circulation openings on side walls;

wherein the shell covers the housing, and slots located on sides of the shell are aligned with the plurality of openings on the housing.

20. The illumination device of claim 19, wherein the reflection body further comprises a bottom surface that lies parallel to the top surface of the substrate when attached with the substrate.

21. The illumination device of claim 19, wherein the inclined angle is between 5 degree and 90 degrees.

22. The illumination device of claim 19, wherein the housing is fixed with the substrate through a securement member.

23. The illumination device of claim 22, wherein the reflection body is secured on the top surface of the substrate by the securement member.

24. The illumination device of claim 19, wherein the housing further comprises at least one supporter adapted to support the substrate at a distance from a bottom of the housing.

25. The illumination device of claim 19, wherein the shell covers a portion of the housing, the substrate and the reflection body.

26. The illumination device of claim 19, wherein the housing is further provided with at least an opening to allow air circulation and dissipate heat out of the illumination device.

27. The illumination device of any one of claim 19 or 25, wherein the shell is detachably joined with the housing via a hook engagement.

28. The illumination device of claim 19, wherein the diffusion member is formed integrally with the shell.

29. The illumination device of any one of claim 19 or 28, wherein the reflection body and the diffusion member are both formed integrally with the shell.

30. The illumination device of any one of claim 22 or 23, wherein the securement member includes a screw.

31. The illumination device of any one of claim 22 or 23, wherein the securement member includes a hook.

32. The illumination device of claim 20, wherein an adhesive layer is provided between the bottom surface of the reflection body and the top surface of the substrate such that the reflection body is adhesively joined with the top surface of the substrate.

33. The illumination device of claim 19, wherein the housing is further provided with at least one attachment member that is adapted to removably attach the housing with an external device.

34. The external device of claim 33, wherein the external device includes any type of display or audio apparatus.

35. The illumination device of claim 33, wherein the attachment member includes a screw.

36. The illumination device of claim 33, wherein the attachment member includes a hook.

* * * * *